US007147213B1

(12) United States Patent
Amendola

(10) Patent No.: US 7,147,213 B1
(45) Date of Patent: Dec. 12, 2006

(54) GATE STOP

(76) Inventor: Michael Amendola, 1084 Sunrise Hwy., Amityville, NY (US) 11701

( * ) Notice: Subject to any disclaimer, the term of this patent is extended or adjusted under 35 U.S.C. 154(b) by 49 days.

(21) Appl. No.: 10/916,265

(22) Filed: Aug. 11, 2004

(51) Int. Cl.
*E04H 17/14* (2006.01)

(52) U.S. Cl. ..... 256/73

(58) Field of Classification Search ..... 256/1, 256/73; 292/288, 289, 291, 300, 301, DIG. 29; 248/218.4, 219.1, 219.3, 219.4; 16/412, 16/413, 422, 426; 160/368.1, 369
See application file for complete search history.

(56) References Cited

U.S. PATENT DOCUMENTS

| | | | | | |
|---|---|---|---|---|---|
| 1,091,453 | A | | 3/1914 | Fletcher | |
| 3,764,173 | A | | 10/1973 | Griffith | |
| 3,963,269 | A | * | 6/1976 | Rosenberg | 292/346 |
| 4,021,880 | A | * | 5/1977 | Murphy | 16/82 |
| 4,122,631 | A | | 10/1978 | Batcheller | |
| 4,174,862 | A | * | 11/1979 | Shane | 292/346 |
| 4,178,027 | A | * | 12/1979 | Charron | 292/346 |
| 4,303,226 | A | * | 12/1981 | Powell et al. | 256/25 |
| 4,345,787 | A | | 8/1982 | Dabrowski | |
| 4,489,965 | A | * | 12/1984 | Taylor | 292/34 |
| 4,489,968 | A | | 12/1984 | Easley | |
| 4,809,400 | A | | 3/1989 | Allen | |
| 4,831,688 | A | | 5/1989 | Deininger | |
| 5,125,699 | A | * | 6/1992 | Dinan | 292/288 |
| 5,127,690 | A | * | 7/1992 | Kim et al. | 292/340 |
| 5,732,442 | A | * | 3/1998 | Haggard | 16/422 |
| 5,918,915 | A | * | 7/1999 | Calteux | 292/1 |
| 6,422,613 | B1 | * | 7/2002 | Boroviak | 292/100 |
| 6,443,088 | B1 | | 9/2002 | Putman et al. | |
| 6,604,764 | B1 | * | 8/2003 | Zemzik | 292/293 |
| 6,684,566 | B1 | | 2/2004 | LaCook | |
| D511,083 | S | * | 11/2005 | Gurzenda et al. | D8/316 |

FOREIGN PATENT DOCUMENTS

| | | |
|---|---|---|
| CA | 2.272.725 | 8/1999 |
| WO | WO01/44609 | 6/2001 |

* cited by examiner

*Primary Examiner*—Gregory J. Binda
*Assistant Examiner*—Joshua T. Kennedy
(74) *Attorney, Agent, or Firm*—Michael I Kroll

(57) ABSTRACT

A gate stop that extends from the rear lip across the back and side of the gate with a cantilevered portion diverging from the gate across the closure fence post. The gate stop has a plurality of apertures for the placement therein of fasteners to secure the gate stop to the gate. Once installed, the force generated from the engaging gate stop and the fence post are evenly dissipated across the gate preventing warping of the gate or varying torsional forces on the hinges.

2 Claims, 9 Drawing Sheets

GATE STOP

BACKGROUND OF THE INVENTION

1. Field of the Invention

The present invention relates generally to fence gates and, more specifically, to a gate stop that extends from the rear lip across the back and side of the gate with a cantilevered portion diverging from the gate across the closure fence post. The gate stop has a plurality of aperture for the placement of fasteners to secure the gate stop to the gate. Once installed, the force generated from the engaging gate stop and fence post are evenly dissipated across the gate preventing warping of the gate or varying torsional forces on the hinges. An additional element of the present invention includes optional handle members for the user to grasp when opening and closing the gate.

2. Description of the Prior Art

There are other gate stops designed for the same purpose. Typical of these is U.S. Pat. No. 1,091,453 issued to Fletcher on Mar. 24, 1914.

Another patent was issued to Griffith on Oct. 9, 1973 as U.S. Pat. No. 3,764,173. Yet another U.S. Pat. No. 4,021,880 was issued to Murphy on May 10, 1977 and still yet another was issued on Oct. 31, 1978 to Batcheller as U.S. Pat. No. 4,122,631.

Another patent was issued to Dabrowski on Aug. 24, 1982 as U.S. Pat. No. 4,345,787. Yet another U.S. Pat. No. 4,489,968 was issued to Easley on Dec. 25, 1984. Another was issued to Allen on Mar. 7, 1989 as U.S. Pat. No. 4,809,400 and still yet another was issued on May 23, 1989 to Deininger U.S. Pat. No. 4,831,688.

Another patent was issued to Putman, et al. on Sep. 3, 2002 as U.S. Pat. No. 6,443,088. Yet another U.S. Pat. No. 6,684,566 was issued to LaCook on Feb. 3, 2004. Another was issued to LaPorta on 21, Jun. 2001 as WIPO Patent Publication No. WO 01/44609 and still yet another was issued on 1999 to Thornton, et al. as Canadian Patent No. 2,272,725.

U.S. Pat. No. 1,091,453

Inventor: James R. Fletcher

Issued: Mar. 24, 1914

A strike plate having a bolt-receiving socket and obstructing surface in the face of the plate at the rear of said socket.

U.S. Pat. No. 3,764,173

Inventor: Earl H. Griffith

Issued: Oct. 9, 1973

An improved door lock protector assembly is provided. The assembly consists of a protective device to be mounted on the open end of a hinge door and a shaped shield to be mounted around the doorjamb and stop rail. The door mounted device contains escutcheon plates to provide protective strength to the door paneling in the vicinity of the lock and on the outside of the door a flange to prevent the insertion of a flexible tool between the door and the jamb for the purpose of forcing the lock bolt away from engagement in the jamb. The jamb shield serves to protect the jamb and stop rail in the vicinity of the lock to prevent the breaking of the jamb by a force against the door or the prying of the stop rail.

U.S. Pat. No. 4,021,880

Inventor: Edward Patrick Murphy

Issued: May 10, 1977

An improved gate stop is disclosed comprising a flat plate having a forward first section, a central second section, and a rear third section. A narrow slit is cut through the plate following a path beginning at the junction of the second and third sections near the lower boundary of the plate, extending toward the first section, then upwardly toward the upper boundary of the plate, and then toward the third section, and terminating at the junction of the second and said third sections near the upper boundary of the plate. This slit defines the border of a flap which projects outwardly when the third section is bent perpendicular to the second section.

U.S. Pat. No. 4,122,631

Inventor: Roy W. Batcheller

Issued: Oct. 31, 1978

A pipe rail and gate system of uniform metal constituents and simple design utilizes extrusions to form accessory units such as hinges and stop plates to fit the pipe structure, the units being cut from the extruded sections. The shapes of the units and the expedients for fastening the units in place are blended in and function with the rail structure, outlines of the units and their working parts being confined within the dimensions of the rail structure with a minimum of protuberances.

U.S. Pat. No. 4,345,787

Inventor: Zdzislaw T. Dabrowski

Issued: Aug. 24, 1982

A guarded striker plate and guarded latch face plate set which provides for the use of the identical piece on either the doorjamb or on the door. One embodiment uses an L-shaped configuration incorporating a one guard member. A second embodiment uses a Z-shaped member incorporating a two guarded member. Both the L and the Z configuration may also be employed singly or in pairs. In a final embodiment a Z configuration may be used on the door jamb and an L configuration can be used employed on the door providing for maximum security from unauthorized entry.

U.S. Pat. No. 4,489,968

Inventor: Thomas E. Easley

Issued: Dec. 25, 1984

A selectively removable or retractable doorstop for converting double-acting, double or single doors to a single-acting, single door, for permitting control over traffic into and out of public premises at desired times. The doorstop includes an intercept portion which can be selectively removably or retractably inserted into the path of a double-acting door thereby restricting it to opening in one direction only. Different embodiments of the doorstop are provided respectively for temporary or permanent mounting on or in a doorjamb, or on or in the stile of a temporarily fixed-in-place door, thus giving a selection of options for any specific situation.

U.S. Pat. No. 4,809,400

Inventor: Mark L. Allen

Issued: Mar. 7, 1989

Security hardware for an exterior entry door in which a flat piece of metal is bent into a J-shaped door jamb mounted component and in which an aperture through which a door mounted article of hardware can project is provided in the single layer part an aligned buck pin apertures are provided in the double layer part of the component. A buck pin having a head portion and a grooved portion spaced therefrom is also provided as is a slotted retaining member that when positioned between the double layer of the component engages the grooved portion of the buck pin to prevent its removal from the buck pin apertures.

U.S. Pat. No. 4,831,688

Inventor: James M. Deininger

Issued: May 23, 1989

A mechanism which prevents a door from closing by blocking the door hinge from closing.

U.S. Pat. No. 6,443,088

Inventor: David L. Putman, et al.

Issued: Sep. 3, 2002

The present invention involves a gate assembly for a pontoon boat. The pontoon boat includes a platform deck atop a flotation device with a protective railing having fence sections and gate assemblies at least partially surrounding the deck. The gate assembly is disposed in a gap or opening in the protective fence between two of the fence sections and includes a gate, a gate stop, and a sliding hinge. The gate is attached by the hinge to one of the two fence sections at the opening of the protective railing, and the stop is attached to the other of the two fence sections and includes a stop member extending from the deck to near the top of the fence that will prevent the gate from swinging outwardly. The stop member includes a padding strip thereon between the stop member and the gate, which prevents rattling between the stop member and the gate.

U.S. Pat. No. 6,684,566

Inventor: David LaCook

Issued: Feb. 3, 2004

On a spring-biased safety gate, a guard plate is mounted to a gate member with the same hardware that mounts the stop to the gate. The guard plate is preferably formed of plate metal to define a plate mounting area and a pair of guard plates that extend perpendicularly from either side of the plate mounting area. In that way, each of the pair of guard plates extends in a direction parallel to the gate a distance sufficient to shield the mounting hardware behind the guard plate and the stop.

WIPO Patent Publication No. WO 01/44609

Inventor: Maria Laporta

Published: 21, Jun. 2001

A window or door assembly comprising a frame member and a leaf hingedly moveable relative to the frame member, the leaf having a rear edge which in the closed position of the window or door lies adjacent to the frame member, the assembly further comprising stop means for acting between the frame member and said rear edge of the leaf for holding the leaf in an open position, said stop means being substantially concealed from view when the leaf is in a closed position.

Canadian Patent Number 2,272,725

Inventor: James Thornton, et al.

Issued: 2, Jun. 2002

A protective doorjamb system integrally connected to a door frame. The doorjamb system of the present invention includes a door stop and a cladding. The doorjamb system protects the door frame from exposure to outdoor weather conditions.

While these devices may be suitable for the purposes for which they were designed, they would not be as suitable for the purposes of the present invention, as hereinafter described.

SUMMARY OF THE PRESENT INVENTION

The present invention discloses a gate stop mounted to a gate for engaging a fence post. The shape of the gate stop conforms substantially to a Z-shape having a coplanar lip whereby the gate stop securely engages the gate frame on three sides. The gate stop is comprised of a first planar portion for engaging and transferring the closure forces from the gate across the fence post. Transversely extending from the first planar portion is a second planar portion that engages a first gate frame side opposing the fence post. A third planar portion depends from the second planar portion in a transverse direction occurring co-parallel with the first planar portion relatively forming a Z-shape. Extending from the third planar portion is a forth planar portion co-parallel with the second planar portion therein forming a receptacle for the gate frame. Once the gate stop is positioned on the gate frame a plurality of apertures within the gate stop provide means for fixedly fastening the gate stop to the gate frame.

A primary object of the present invention is to provide a gate stop that is positioned on a gate frame.

Another object of the present invention is to provide a gate stop that provides means for disbursing the closure forces towards the center of a gate.

Yet another object of the present invention is to provide a gate stop that can be mounted on any style gate.

Another object of the present invention is to provide a gate stop having a pair of opposing handle members to facilitate opening and closing the gate from either side.

Still yet another object of the present invention is to provide a gate stop that is ideal for maintaining gate alignment for latch and hinges, prolonging the life of the gate.

Additional objects of the present invention will appear as the description proceeds.

The present invention overcomes the shortcomings of the prior art by providing a gate stop that extends from the rear lip across the back and side of the gate with a cantilevered portion diverging from the gate across the closure fence post. The gate stop has a plurality of aperture for the placement of fasteners to secure the gate stop to the gate. Once installed, the force generated from the engaging gate stop and fence post are evenly dissipated across the gate preventing warping of the gate or varying torsional forces on the hinges.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
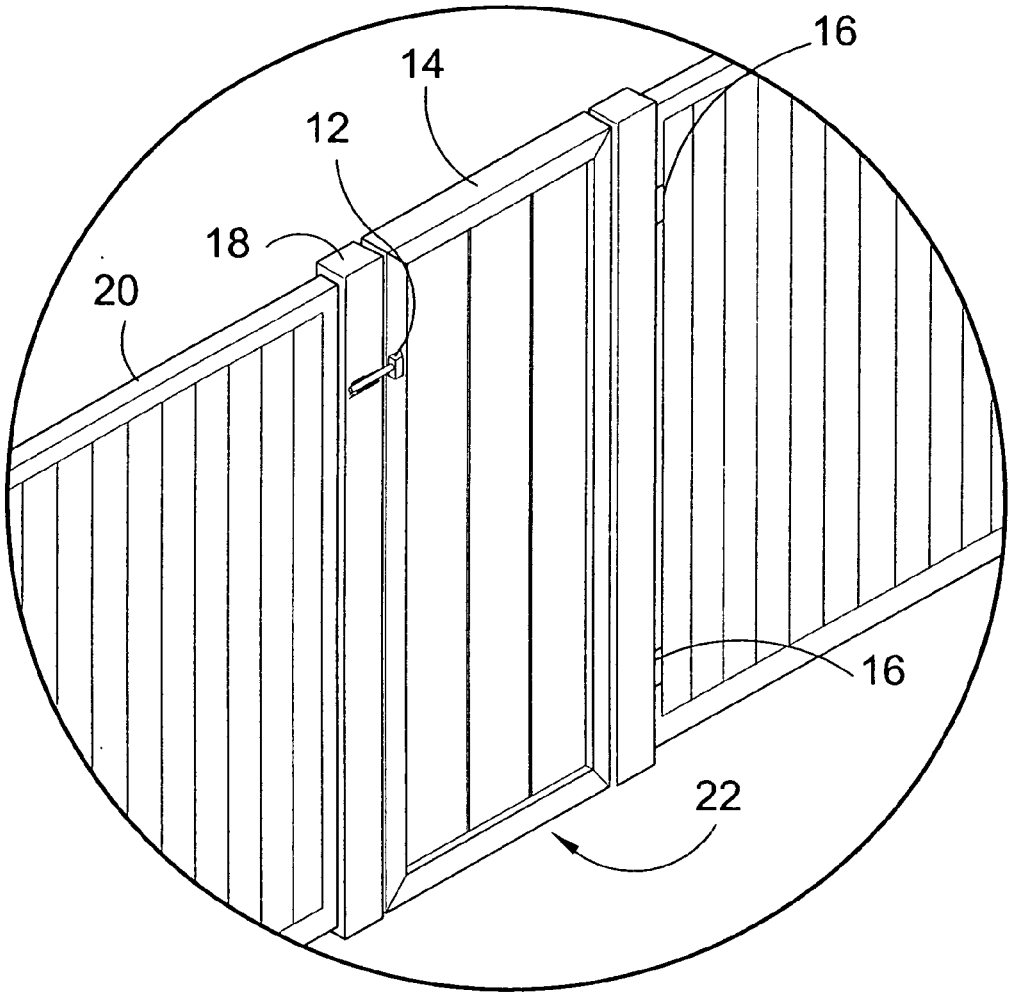
FIG. 1 (PRIOR ART)
FIG. 1 is an illustrative view of prior art.

With regard to reference numerals used, the following numbering is used throughout the drawings.

10 present invention
12 conventional gate latch
14 gate
16 hinge
18 post
20 fence
22 arrow
24 rear lip of gate
26 cantilevered portion/first portion
28 apertures
30 fastener
34 second portion
36 third portion
38 fourth portion
40 frame of gate
42 first handle member
44 second handle member

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the prior art. Shown is an illustrative view of the prior art wherein a gate latch 12 is located on the top end of the gate 14 for ease of use. Since gates 14 have some means of tensioning for closure, this causes torsional forces on the gate hinges 16 due to the only point of contact between the gate and post 18 being the gate latch 12, which leads to premature failure or periodic maintenance to prevent failure of the latch 12 and hinges 16. Also shown are the fence 20 and direction of closure at arrow 22.

Figure 2:
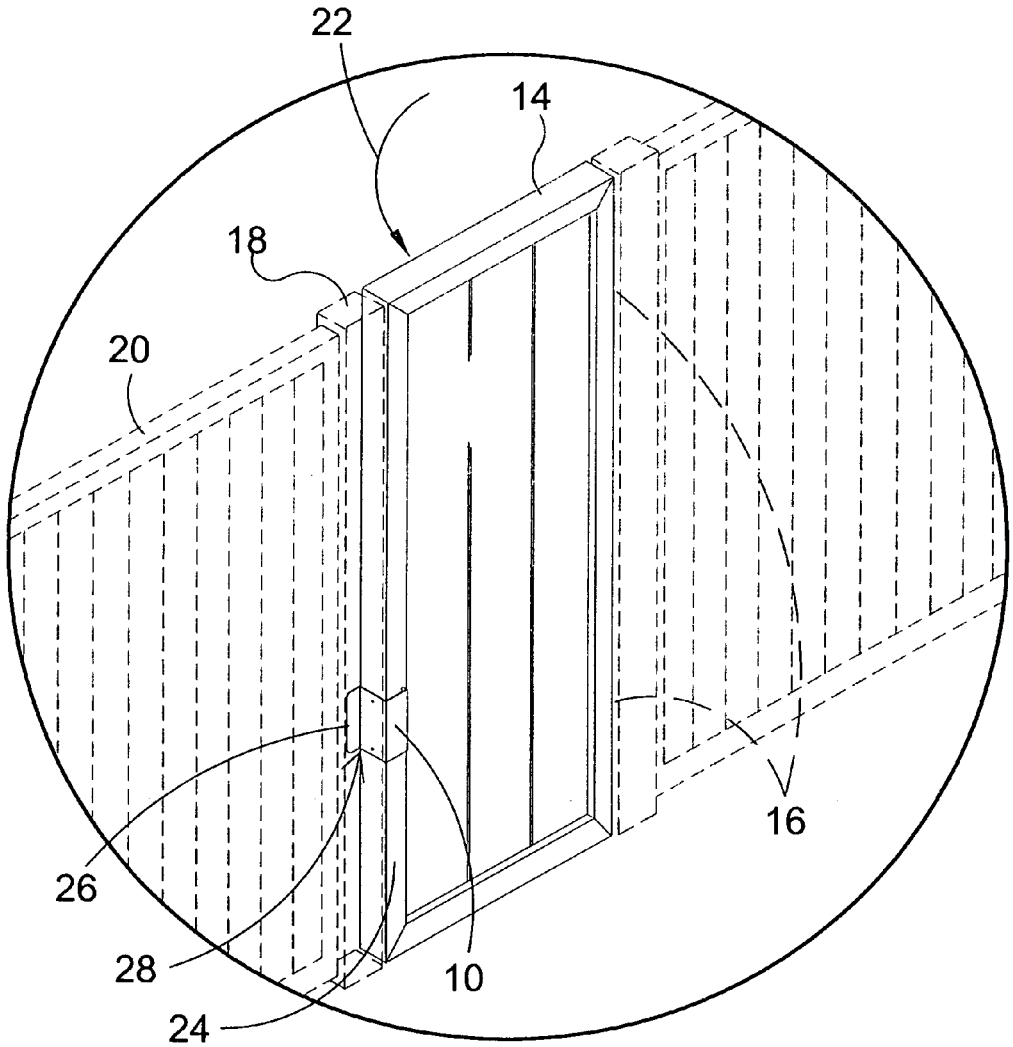
FIG. 2 is an illustrative view of the present invention in use.

Turning to FIG. 2, shown therein is an illustrative view of the present invention 10 in use. The present invention 10 is a gate stop that extends from the rear lip 24 of the gate 14 across the back and side of the gate 14 with a cantilevered portion 26 diverging from the gate across the front of the closure fence post 18. The gate stop 10 has a plurality of apertures 28 for the placement of fasteners to secure the gate stop to the gate 14. Once installed, the force generated from the engaging gate stop 10 and fence post 18 are evenly dissipated across the gate preventing warping of the gate or varying torsional forces on the hinges 16. Also shown are the fence 20 and direction of closure at arrow 22.

Figure 3:
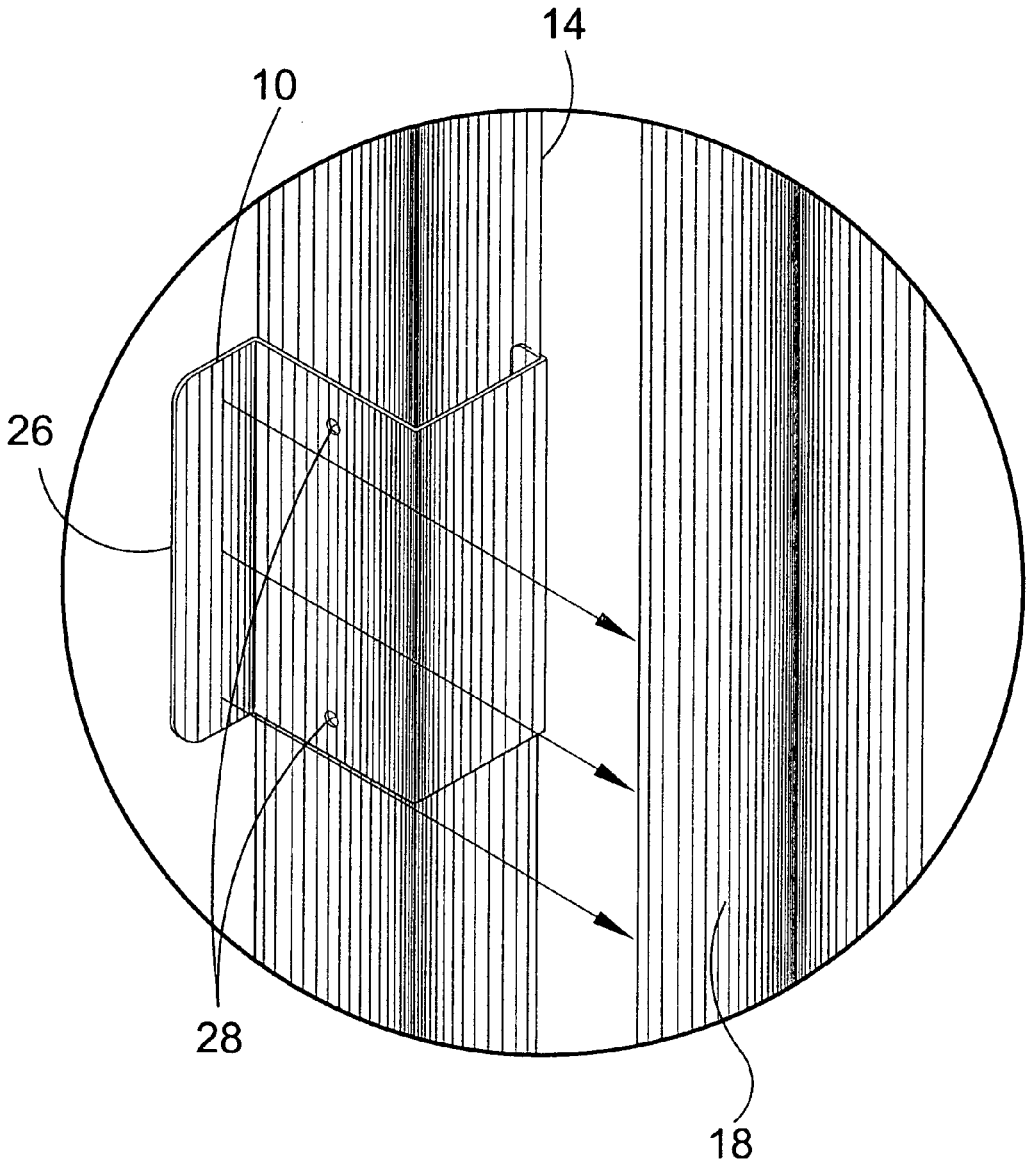
FIG. 3 is an enlarged view of the present invention in use.

Turning to FIG. 3, shown therein is an enlarged view of the present invention 10 in use. Shown is an enlarged view of the gate stop 10. The gate stop 10 is comprised of a z-shaped structure having a coplanar lip 26 on the tail end. The portion of the structure having the lip conforms substantially to the width and depth of the gate frame. Once mounted on the gate frame 14, apertures 28 within the gate stop 10 provide means for securing the gate stop to the gate frame. Fence post 18 is also shown.

Figure 4:
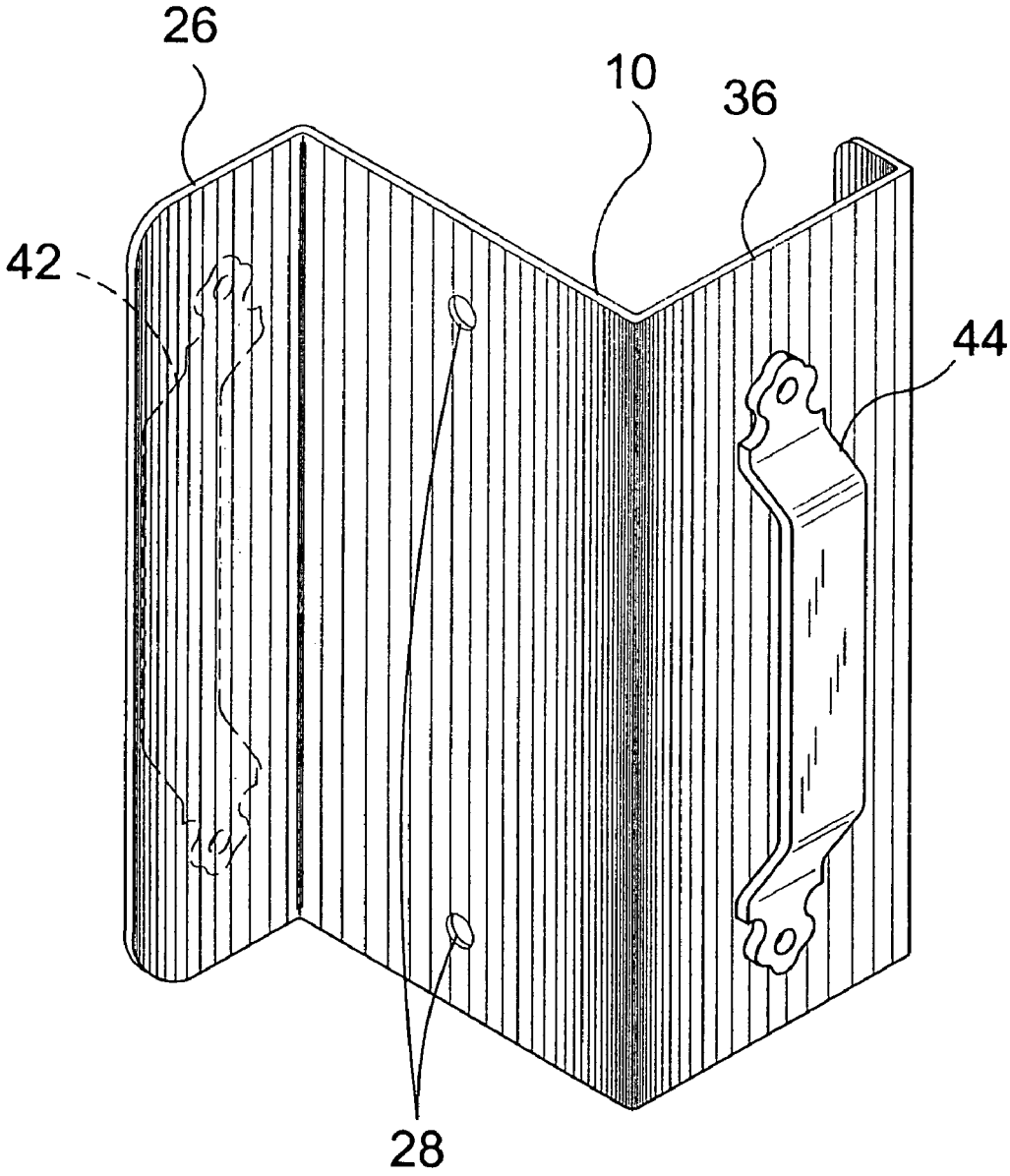
FIG. 4 is a perspective view of the front side of the gate stop.

Turning to FIG. 4, shown therein is a perspective view of the front side of the gate stop 10. Shown is the front side of the present invention conforming substantially to a z-shape having a coplanar lip 26. The gate stop 10 securely engages the gate frame on three sides. Depending from the gate stop 10 in cantilever fashion is the fence gate closure post engaging element 26 that is sized in length and depth to impact an area of the fence closure post whereby the applied force occurs across the body of the post. Apertures 28 are also shown. Also shown in FIG. 4 and the subsequent drawing figure is an additional element of the present invention wherein the gate stop includes a pair of opposing handle members 42,44 wherein a first handle member 42 is disposed on the outer side of the cantilevered portion 26 and a second handle member 44 is disposed on the outer side of the third portion 36 of the gate stop 10.

Figure 5:
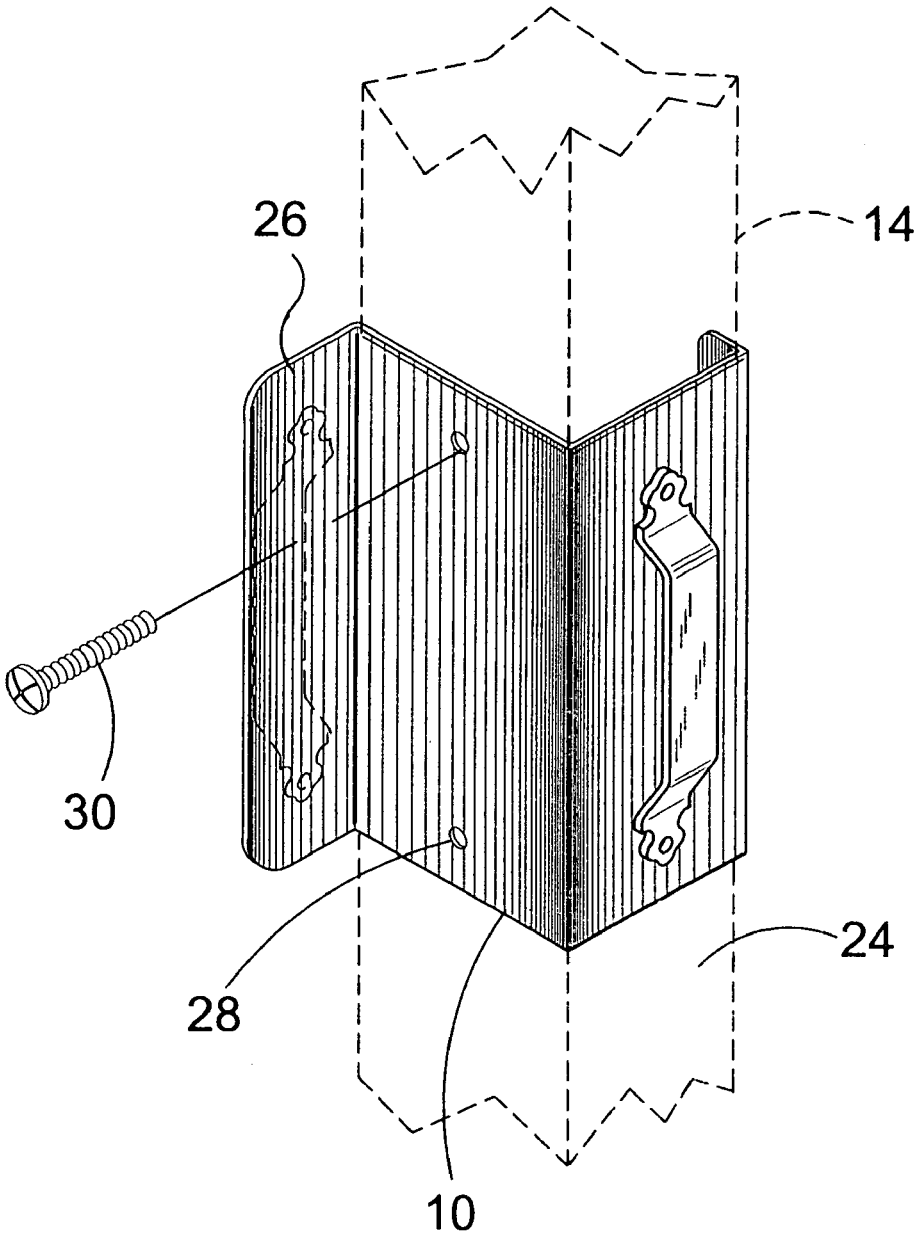
FIG. 5 is a perspective view of the present invention being mounted to a gate jamb.

Turning to FIG. 5, shown therein is a perspective view of the present invention 10 being mounted to a gate 14 frame. Shown is the gate stop 10 being attached to a gate frame 14. As illustrated, the gate stop 10 extends from the rear lip 24 of the gate across the back and side of the gate frame 14 with a cantilevered portion 26 diverging from the gate across the closure fence post. The gate stop 10 has a plurality of apertures 28 for the placement of fasteners 30 to secure the gate stop to the gate 14. Once installed, the force generated from the engaging gate stop 10 and fence post 14 are evenly dissipated across the gate preventing warping of the gate or varying torsional forces on the hinges.

Figure 6:
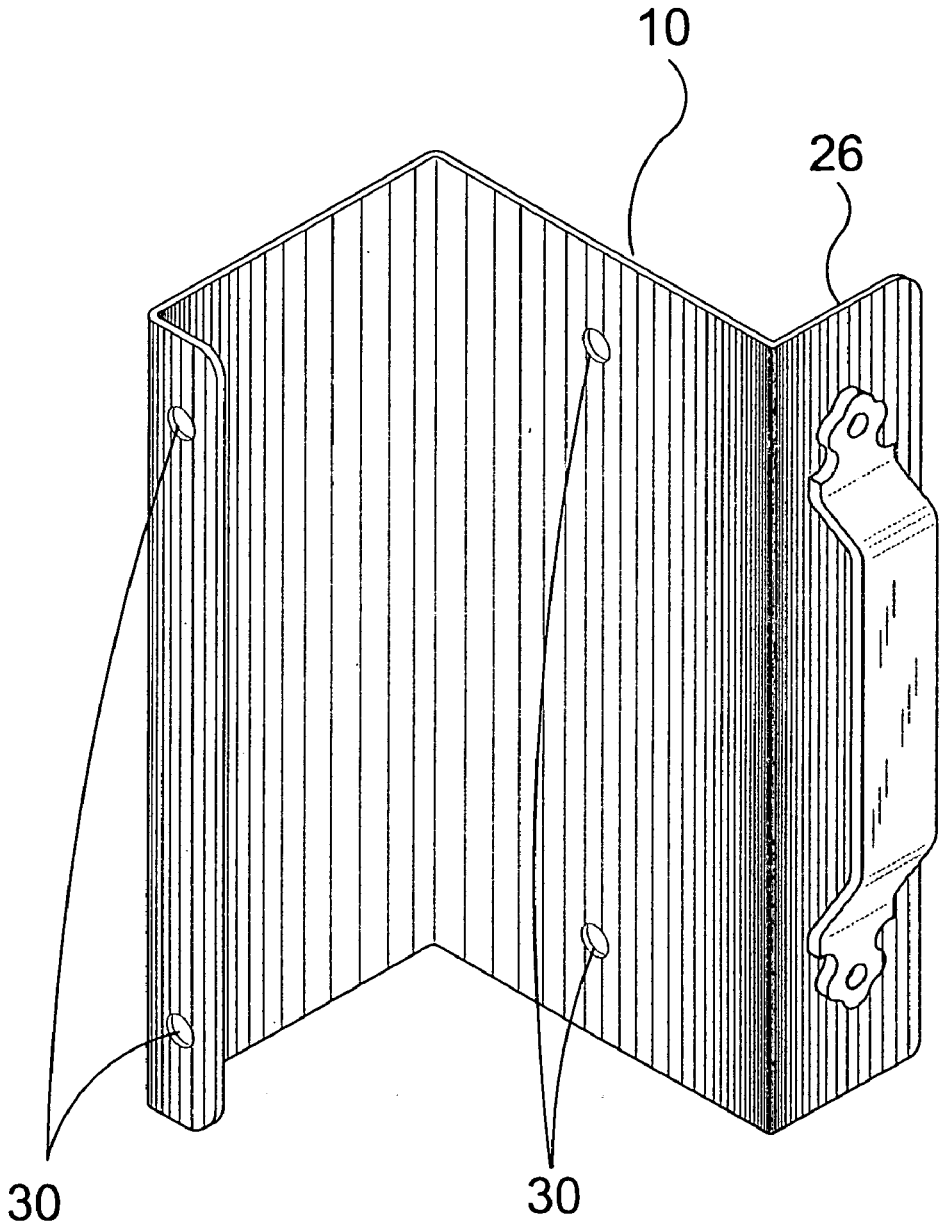
FIG. 6 is a perspective view of the front side of the gate stop.

Turning to FIG. 6, shown therein is a perspective view of the back side of the gate stop 10. Shown is the back side of the present invention 10 conforming substantially to a z-shape having a coplanar lip 26. The gate stop 10 securely engages the gate frame on three sides. Depending from the gate stop 10 in cantilever fashion is the fence gate closure post engaging element 26 that is sized in length and depth to impact an area of the fence closure post whereby the applied force occurs across the body of the post. Apertures 28 are also shown.

Figure 7:
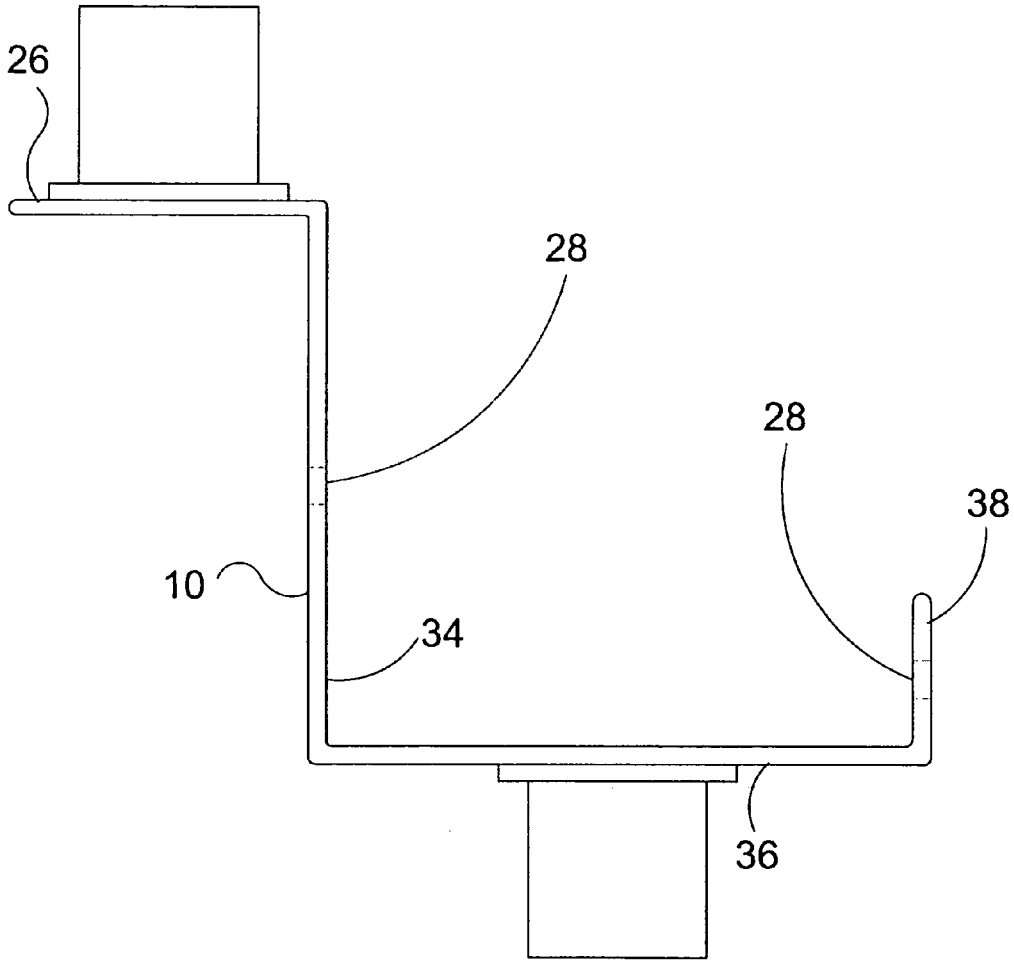
FIG. 7 is a top view of the present invention.

Turning to FIG. 7, shown therein is a top view of the present invention 10. Shown is a gate stop 10 comprising a first planar portion 26 for engaging and transferring the closure forces from the gate across the fence post. Transversely extending from the first planar portion 26 is a second planar portion 34 that engages a first gate frame side opposing the fence post. A third planar portion 36 depends from the second planar portion 34 in a transverse direction occurring co-parallel with the first planar portion 26 relatively forming a z-shape. Extending from the third planar portion 36 is a forth planar portion 38 co-parallel with the second planar portion 34 therein forming a receptacle for the gate frame. Once the gate stop 10 is positioned on the gate frame a plurality of apertures 28 within the gate stop provide means for fixedly fastening the gate stop to the gate jamb.

Figure 8:
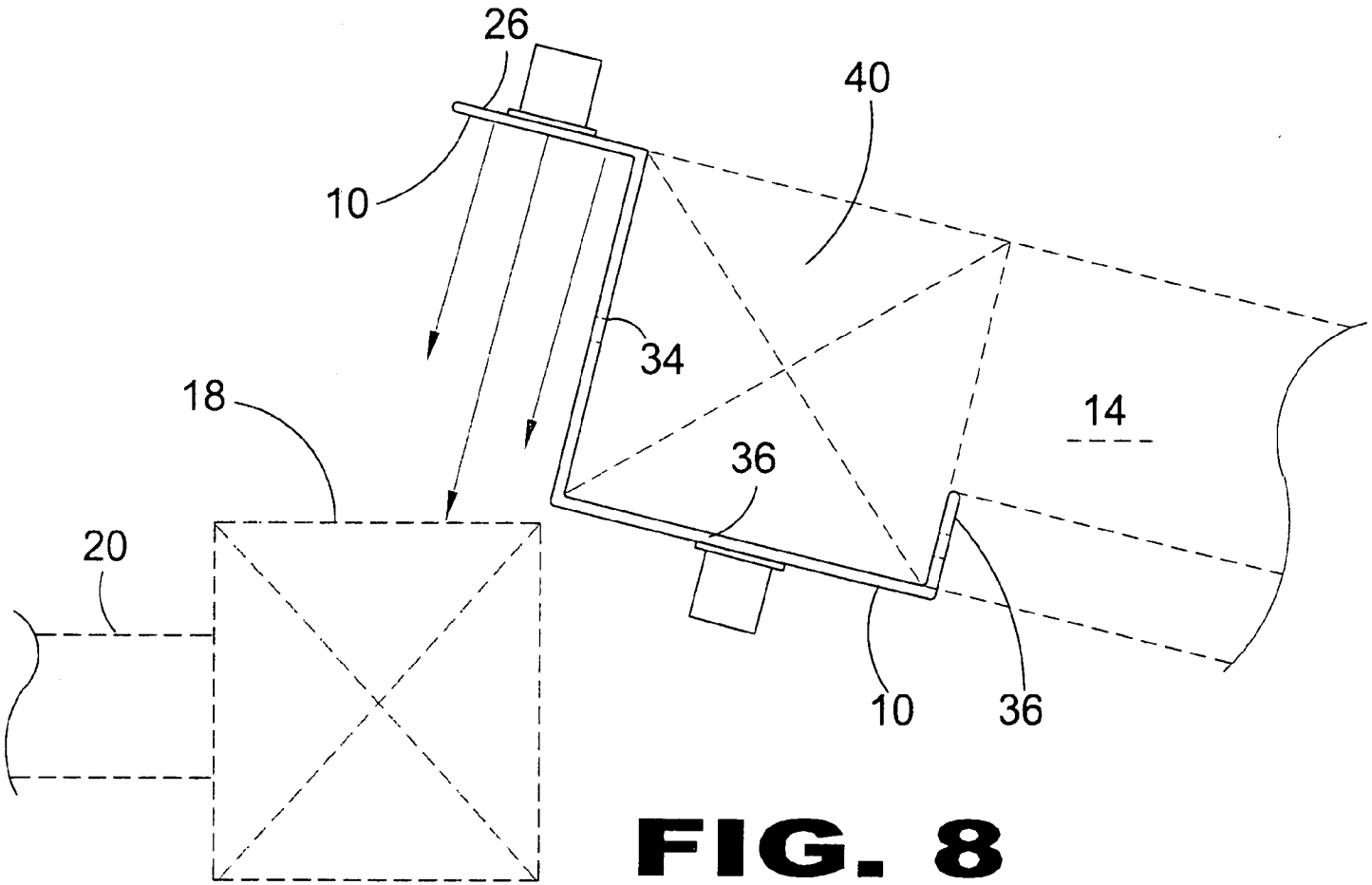
FIG. 8 is a top view of the present invention moving to engage a fence post.

Turning to FIG. 8, shown therein is a top view of the present invention 10 moving to engage a fence post 18 of fence 20. Shown is a top view of the present invention 10 mounted to a gate 14 moving to engage a fence post 18. The shape of the gate stop 10 conforms substantially to a z-shape having a coplanar lip 38 whereby the gate stop securely engages the gate frame 40 on three sides. Depending from the gate stop 10 in cantilever fashion is the fence gate closure post engaging element 26 that is sized in length and depth to impact the outer area of the fence closure post 18 whereby the force generated from the engaging gate stop and fence post are evenly dissipated across the gate preventing warping of the gate or applying varying torsional forces on the hinges. The view discloses that the substantially z-shaped structure 10 having a coplanar lip 38 on the tail end conforms substantially to the width and depth of the gate frame 40. Once mounted on the gate frame 14, apertures within the gate stop 10 provide means for securing the gate stop to the gate jamb. Other elements previously shown are also disclosed.

Figure 9:
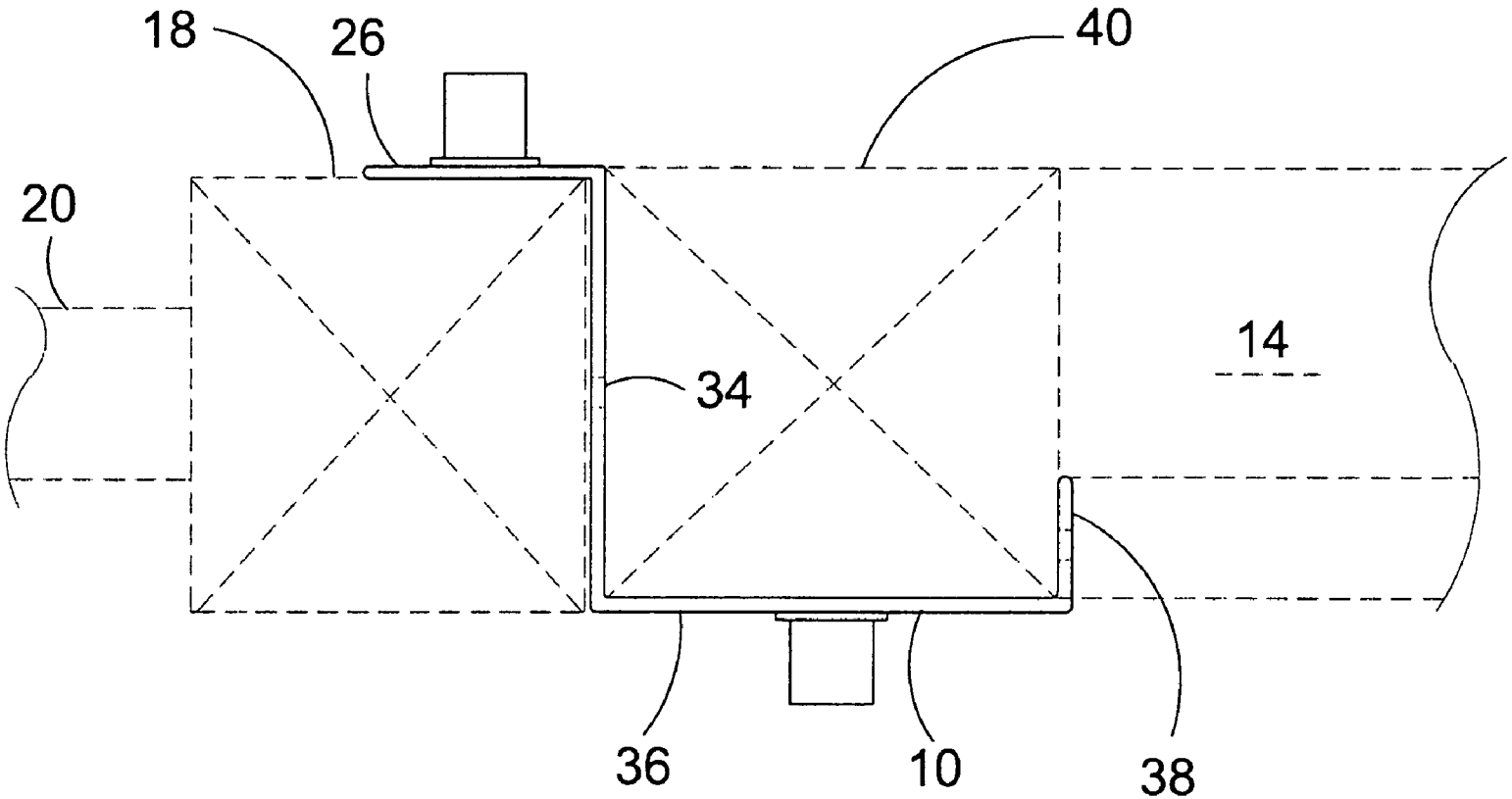
FIG. 9 is a top view of the present invention engaging a fence post.

Turning to FIG. 9, shown therein is a top view of the present invention 10 engaging a fence post 18 of fence 20. Shown is a top view of the present invention 10 mounted to a gate 14 engaging a fence post 18. The shape of the gate stop 10 conforms substantially to a Z-shape having a coplanar lip 38 whereby the gate stop securely engages the gate frame 40 on three sides. The gate stop 10 is comprised of a first planar portion 26 for engaging and transferring the closure forces from the gate across the fence post outer side 18. Transversely or perpendicularly extending from the first planar portion 34 is a second planar portion that engages a first, outer gate frame 40 side opposing the fence post 18. A third planar portion 36 depends from the second planar portion 34 in a transverse perpendicular direction engaging the inner side of the frame of the gate occurring parallel with the first planar portion 26 relatively forming a Z-shape. Extending perpendicularly from the third planar portion 36 is a forth planar portion 38 parallel with the second planar portion 34 engaging a second side of the frame of the gate opposite to the first side, therein forming a receptacle for the gate frame 40. Once the gate stop 10 is positioned on the gate frame 40 a plurality of apertures within the gate stop provide means for fixedly fastening the gate stop to the gate frame.

I claim:

1. A gate stop of single piece construction, the gate stop being mounted onto the frame of a gate, the frame of the gate being contiguous to the post of a fence, the frame of the gate having a first outer side, an inner side and a second side opposite said first side, the post of the fence having an outer side, the frame of the gate and the post of the fence being substantially rectangular shaped, comprising:

a) a first rectangular shaped planar solid portion for engaging the outer side of the post of the fence;

b) a second rectangular shaped planar solid portion perpendicular to said first planar portion and joined at a common edge with each other, wherein said second planar portion engages the first, outer side of the frame of the gate, said second planar solid portion having only apertures and a first set of fasteners passing through said apertures for attaching said second planar portion the frame of said gate;

c) a third rectangular shaped planar solid portion perpendicular to said second planar portion and parallel to said first planar portion joined at a common edge with each other opposite the edge joining the first and second planar portions, wherein said third planar portion engages the inner side of the frame of the gate;

d) a fourth rectangular shaped solid planar portion perpendicular to said third planar portion and parallel to said second planar portion joined at a common edge with each other opposite the edge joining the second and third planar portions, wherein said fourth planar portion engages the second side of the frame of the gate opposite to the first, outer side of the frame of the gate, said fourth planar portion having only apertures and a second set of fasteners passing therethrough for attaching said fourth planar portion to said frame of said gate, the first and second set of fasteners being on opposite sides of said frame of said gate, and all adjoining edges of all adjacent portions being solid;

e) a first U-shaped handle member mounted on a surface of said first planar portion away on any edges thereof; and f) a second handle member mounted on a surface of said third planar portion away from any edges thereof.

2. A gate stop of single piece construction, comprising:

a) a gate stop being disposed onto the frame of a gate, said frame of the gate being contiguous to the post of a fence, said frame of the gate having a first outer side, an inner side and a second side opposite said first side, said post of the fence having an outer side, said frame of the gate and said post of the fence being substantially rectangular shaped, said gate stop having only four planar portions made up of first, second, third and fourth planar portions;

b) said first planar solid portion for engaging said outer side of said post of the fence;

c) said second planar solid portion perpendicular to said first planar portion, wherein said second planar portion engages said first, outer side of said frame of the gate, said second planar portion having only apertures with a first set of fasteners passing therethrough into said first, outer side of said frame of said gate;

d) said third planar solid portion perpendicular to said second planar portion and parallel to said first planar portion, wherein said third planar portion engages said inner side of said frame of the gate;

e) said fourth planar solid portion perpendicular to said third planar portion and parallel to said second planar portion, all of the fourth planar portion extending toward said first planar portion, wherein said fourth planar portion engages said second side of said frame of the gate opposite to said first, outer side of said frame of the gate, said fourth planar portion having only apertures therein and a second set of fasteners passing therethrough into said second side of said frame of the gate opposite to said first, outer side of said frame of the gate, and all adjoining edges of all adjacent portions being solid;

f) a first handle member disposed on said first portion opposite the side engaging said post of the fence; and g) a second handle member disposed on said third portion opposite the side engaging said gate.

* * * * *